US007606522B2

(12) United States Patent
Rohde et al.

(10) Patent No.: US 7,606,522 B2
(45) Date of Patent: Oct. 20, 2009

(54) MICROWAVE FUSER APPARATUS WITH OVERLAPING HEAT APPLICATORS

(75) Inventors: Domingo Rohde, Kiel (DE); Knut Behnke, Flintbek (DE); Detlef Schulze-Hagenest, Molfsee (DE); Frank-Michael Morgenweck, Kiel (DE); José Manuel Catalá-Civera, Valencia (ES)

(73) Assignee: Eastman Kodak Company, Rochester, NY (US)

( * ) Notice: Subject to any disclaimer, the term of this patent is extended or adjusted under 35 U.S.C. 154(b) by 173 days.

(21) Appl. No.: 11/739,319

(22) Filed: Apr. 24, 2007

(65) Prior Publication Data

US 2008/0267679 A1 Oct. 30, 2008

(51) Int. Cl.
*G03G 15/20* (2006.01)

(52) U.S. Cl. ..... 399/336; 399/335; 399/320

(58) Field of Classification Search ..... 399/366; 219/678, 679, 697, 695, 690
See application file for complete search history.

(56) References Cited

U.S. PATENT DOCUMENTS 4,187,405 A * 2/1980 Puschner et al. ..... 219/691
5,423,260 A * 6/1995 Goldberg et al. ..... 101/424.1
5,536,921 A * 7/1996 Hedrick et al. ..... 219/693
6,693,266 B1 * 2/2004 Yagi ..... 219/695
7,208,710 B2 * 4/2007 Gregoire et al. ..... 219/697
2002/0088799 A1 7/2002 Behnke et al.
2003/0013034 A1 1/2003 Behnke et al.
2004/0206755 A1 * 10/2004 Hadinger ..... 219/761
2007/0079718 A1 4/2007 Behnke et al.

* cited by examiner

*Primary Examiner*—David M Gray
*Assistant Examiner*—Rodney Bonnette
(74) *Attorney, Agent, or Firm*—William R. Zimmerli

(57) ABSTRACT

A microwave fuser apparatus, for a reproduction apparatus, the microwave fuser apparatus having at least two microwave applicators, staggered relative to a receiver member transport path with an area of overlap, for applying microwave energy to a receiver member traveling on such transport path relative to the microwave applicators to have toner images fused thereto. The microwave fuser apparatus has at least one additional microwave applicator, located adjacent to the overlapping area between the at least two staggered microwave applicators that applies microwave energy to the receiver member. The at least one additional microwave applicator effectively maintains an elevated temperature of a receiver member.

5 Claims, 3 Drawing Sheets

MICROWAVE FUSER APPARATUS WITH OVERLAPING HEAT APPLICATORS

FIELD OF THE INVENTION

This invention relates in general to an electrostatographic reproduction apparatus, and more particularly to a microwave fuser for fusing toner images on receiver members in an electrostatographic reproduction apparatus wherein the microwave fuser includes heater applicators staggered in both the cross-track and in-track receiver member transport direction.

BACKGROUND OF THE INVENTION

In typical commercial reproduction apparatus (electrostatographic copier/duplicators, printers, or the like), a latent image charge pattern is formed on a uniformly charged charge-retentive or photoconductive member having dielectric characteristics (hereinafter referred to as the dielectric support member). Pigmented marking particles (dry ink) are attracted to the latent image charge pattern to develop such image on the dielectric support member. A receiver member, such as a sheet of paper, transparency or other medium, is then brought into contact with the dielectric support member, and an electric field applied to transfer the dry ink developed image to the receiver member from the dielectric support member. After transfer, the receiver member bearing the transferred image is transported away from the dielectric support member, and the image is fixed (fused) to the receiver member by heat and pressure to form a permanent reproduction thereon.

In electrostatographic reproduction apparatus, the toner images can be fixed on respective receiver member by microwaves. The procedure of the microwave fusing is a volume-heating procedure and melts the toner on the front and back of the receiver member to be fixed simultaneously to both sides of the receiver member. When printing individual receiver member sheets, it is advantageous for the receiver member transport to warm up the receiver member in segments and to thus fix the toner in such segments. This is accomplished for example by arranging several microwave applicators in a staggered fashion in direction of the receiver member transport (in-track direction) as well as in the direction transverse to the transport direction of the receiver member (cross-track direction).

An overlapping range of few millimeters in width must exist between the areas warmed up by the individual applicators due to the heating profiles in the individual applicators transverse to the transportation direction. The image quality within the overlapping range is unfavorably affected, if the receiver member and the toner on such receiver member cool down too much between the warming up steps. Thus the gloss and possibly the density of the print image will be different within the overlapping range in comparison to the remaining print area, due to the fact that the toner warms up in only one applicator and cools down afterwards. In order to avoid this warm up/cool down phenomena, cooling of the receiver member within the overlapping range, below a critical temperature, must be avoided. Devices based on IR or UV radiation, or on hot air have the disadvantage that they cannot easily and precisely be restricted to heating in the overlapping range, which can lead to further negative influences on the image quality.

SUMMARY OF THE INVENTION

In view of the problems discussed above, this invention is directed to a microwave fuser apparatus, for a reproduction apparatus, the microwave fuser apparatus having at least two microwave applicators, staggered relative to a receiver member transport path with an area of overlap, for applying microwave energy to a receiver member traveling on such transport path relative to the microwave applicators to have toner images fused thereto. The microwave fuser apparatus has at least one additional microwave applicator, located adjacent to the overlapping area between the at least two staggered microwave applicators that applies microwave energy to the receiver member. The at least one additional microwave applicator effectively maintains an elevated temperature of a receiver member.

BRIEF DESCRIPTION OF THE DRAWINGS

In the detailed description of the preferred embodiment of the invention, presented below, reference is made to the accompanying drawings, in which.

DETAILED DESCRIPTION OF THE INVENTION

Figure 1:
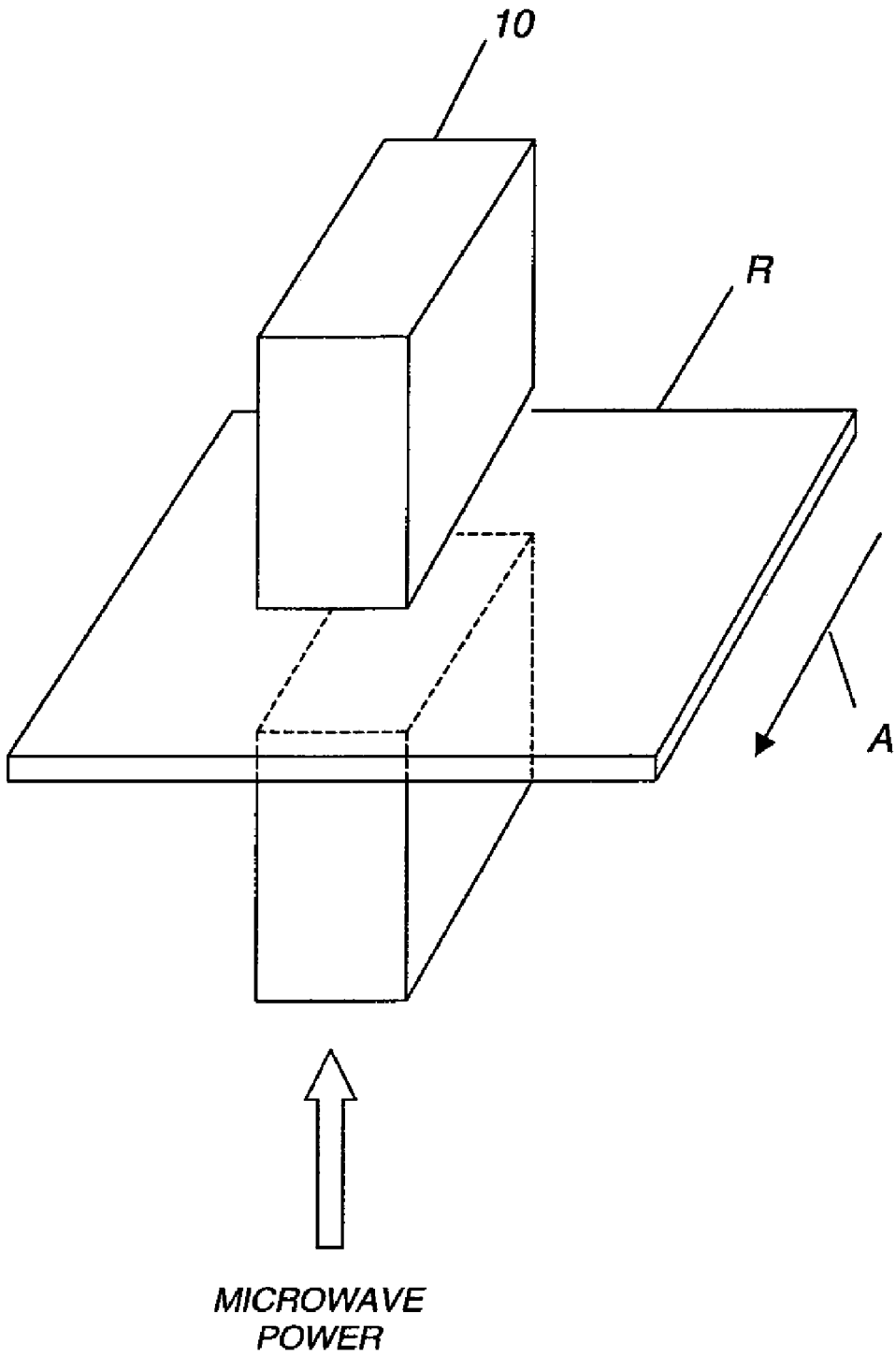
FIG. 1 is a view, in perspective, of a receiver member passing through a microwave fuser of an electrostatographic reproduction apparatus.
Figure 2:
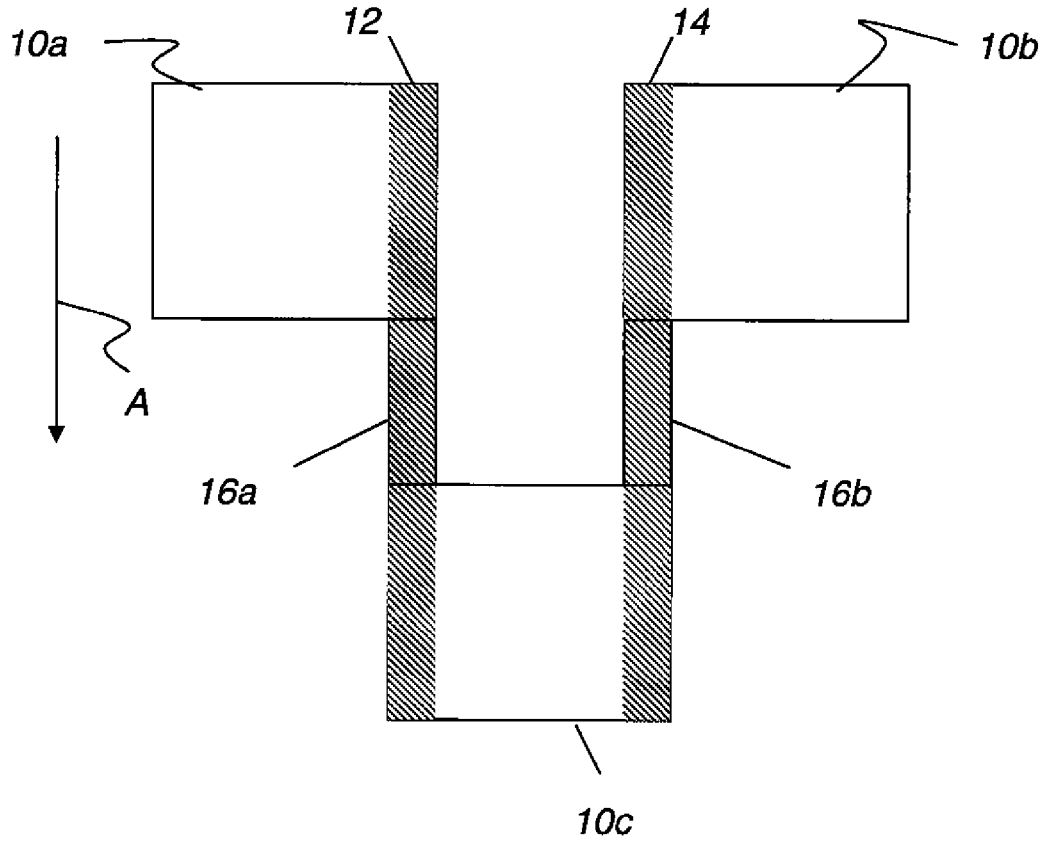
FIG. 2 is a top plan view of a microwave fuser of an electrostatographic reproduction apparatus having staggered, overlapping microwave applicators.

Referring now to the accompanying drawings, FIG. 1 shows a microwave fuser apparatus 10, relative to a receiver member R transported along a travel path indicated by arrow A. As discussed above, a microwave fuser apparatus may include a plurality of applicators staggered, both in the direction of and cross track to the receiver member travel path, so as to effectively fuse a toner image to the receiver member in segments. See FIG. 2 were the plurality of applicators, shown in a plan view, are designated 10*a*, 10*b*, and 10*c* (of course the number of staggered applicators is not limited to three, but is dependent upon the dimensions of standard microwave applicators and the dimensions of the receiver member transported in the travel path through the fuser apparatus). As noted, staggering of the applicators yields areas (in the shown portion, designated by the numerals 12, 14) where heating overlaps in sequential locations. In order to prevent adverse temperature conditions (heating or cooling) in the overlapping areas, this invention provides additional applicators (in the shown portion designated as 16*a*, 16*b*) adjacent to the overlapping areas. The additional applicators are relatively thin so as to be effective substantially only over the overlapping areas.

Figure 3:
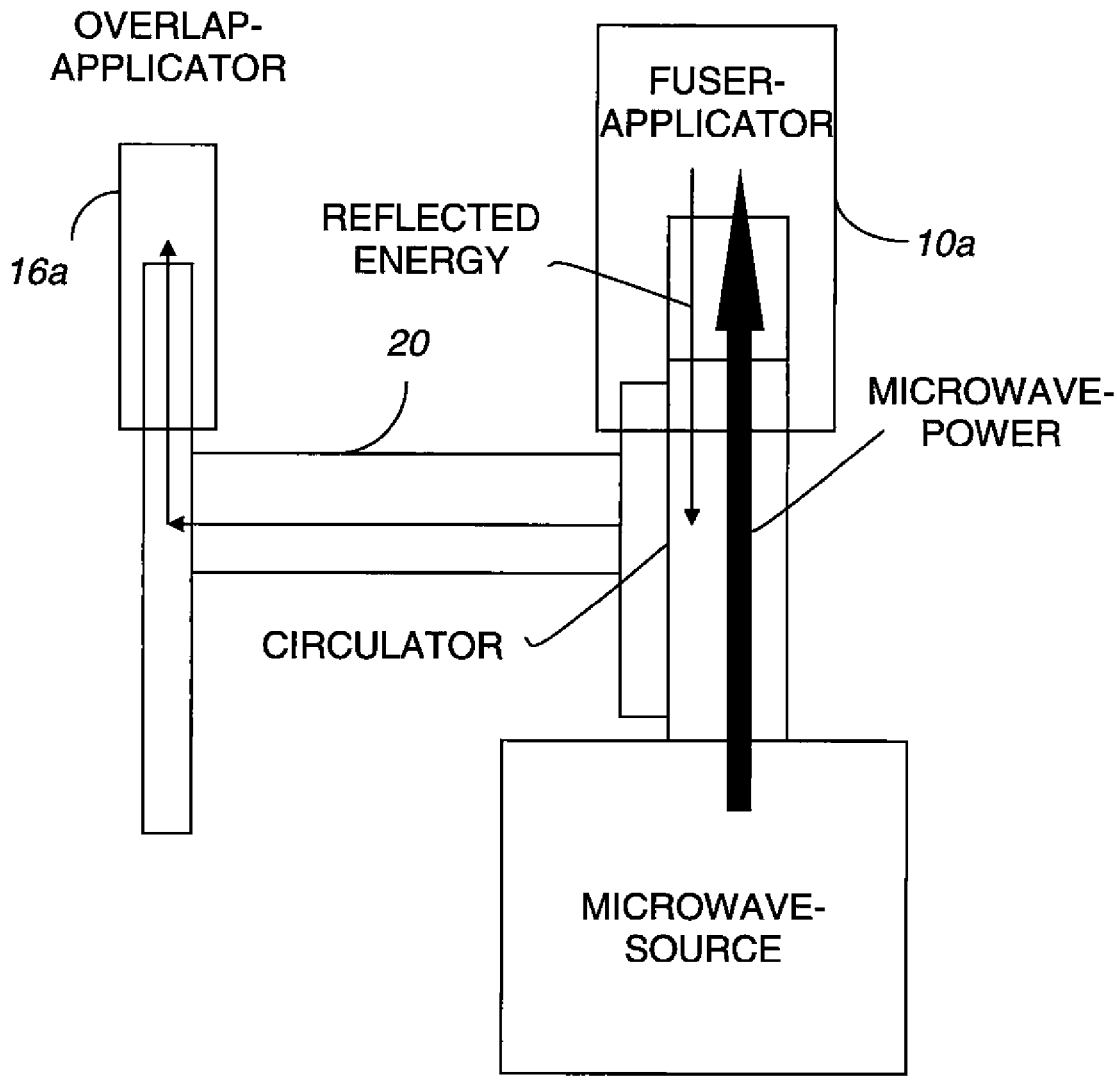
FIG. 3 is a top plan view of a microwave fuser applicator having an overlap applicator, according to this invention.

The overlap heating effected by the thin microwave fuser applicators (e.g., 16*a*, 16*b*) according to this invention provides a number of distinct and unexpected advantages. The applicators (e.g., 16*a*, 16*b*) adjacent to the overlapping areas (e.g., 12, 14) do not need their own source of microwave energy. The microwave energy for such additional applicators can be provided by reflected energy from the main applicators (e.g., 10*a*, 10*b*, or 10*c* in FIG. 2) used for primary fusing (see FIG. 3). A condition for it is the installation of a circulator into the power connection inlet to the applicators. The circulator uncouples the energy not necessary for the fusing process, so that the power can be supplied to the overlap applicator (e.g., 16*a*) using a suitable connection (e.g. 20) between circulator and overlap applicator. This is a favorable arrangement in that the necessary microwave power to keep the receiver member warm in the overlap area (e.g., 12, 14) is inversely proportional to the microwave power necessary for fusing the receiver member in accordance with the receiver member-weight. A receiver member with low weight per unit area needs less fusing power than a receiver member with higher weight per unit area. But a receiver member with small weight per unit area cools down faster than one with higher weight per unit area and thus needs a higher microwave power in the overlapping to keep the overlapping range warm. An applicator is optimally adapted to the receiver member by suitable adjustment of a control member within the applicators and by accurate choice of the microwave power, i.e., the microwave energy is absorbed mainly by the receiver member and substantially no reflected energy will arise. Simple increasing of the microwave power without change of the adjusting element may result a possible damage of the receiver member. For this reason for the additional use of an overlap applicator an adjustment of the adjusting element in the applicator is selected, which is not completely optimal, which does not have the provided microwave energy absorbed thus completely from the receiver member, but makes a part available in the form of reflected energy for the narrow applicator within the overlapping range.

An applicator within the overlapping area doesn't need its own control member for matching different receiver members. Tuning of the applicators should, for the above mentioned reasons, be done in a way that light weight receiver member absorbs maximal energy, while heavier receiver member absorbs less energy. Tuning of the applicators to the individual receiver member characteristics can be achieved by suitable and well-known control members (tuners, dielectric loads, plungers for example) and as a result the power adoption to receiver member is thus optimized.

The invention has been described in detail with particular reference to certain preferred embodiments thereof, but it will be understood that variations and modifications can be effected within the spirit and scope of the invention.

What is claimed is:

1. A microwave fuser apparatus, for a reproduction apparatus, said microwave fuser apparatus having at least two microwave applicators, staggered relative to a receiver member transport path with an area of overlap, for applying microwave energy to a receiver member traveling on such transport path relative to said microwave applicators to have toner images fused thereto, said microwave fuser apparatus comprising:

at least one additional microwave applicator, located adjacent to said overlapping area between said at least two staggered microwave applicators that applies microwave energy to the receiver member in only said overlapping area, and a circulator is provided in a microwave energy connection inlet to said applicators, and said circulator uncouples energy not necessary for the fusing process, so that energy can be supplied to said additional applicator using a suitable connection between said circulator and said additional applicator whereby said at least one additional microwave applicator effectively maintains an elevated temperature of a receiver member.

2. The microwave fuser apparatus according to claim 1, wherein said microwave energy for such additional applicators can be provided by reflected energy from said staggered applicators.

3. The microwave fuser apparatus according to claim 1, wherein said the necessary microwave energy to keep a receiver member at a suitable temperature while being transported through said overlap area is inversely proportional to the microwave energy necessary for fusing such receiver member in accordance with the receiver member-weight.

4. The microwave fuser apparatus according to claim 1, wherein energy to said additional applicators is selected such that a light weight receiver member absorbs maximal energy, while a heavier receiver member absorbs less energy.

5. The microwave fuser apparatus according to claim 4, wherein energy to said additional applicators is related to individual receiver member characteristics by suitable and well-known control members, selected from the group of tuners, dielectric loads, and plungers, and as a result energy to a receiver member is optimized.

* * * * *

UNITED STATES PATENT AND TRADEMARK OFFICE

CERTIFICATE OF CORRECTION

PATENT NO. : 7,606,522 B2
APPLICATION NO. : 11/739319
DATED : October 20, 2009
INVENTOR(S) : Knut Behnke et al.

It is certified that error appears in the above-identified patent and that said Letters Patent is hereby corrected as shown below:

| | |
|---|---|
| Title Page, Item [54] Col. 1, line 2, Title | Delete "Heat" and insert -- Heater --, therefor. |
| Column 1, line 2 | Delete "Heat" and insert -- Heater --, therefor. |

Signed and Sealed this

Twenty-ninth Day of December, 2009

David J. Kappos

David J. Kappos
*Director of the United States Patent and Trademark Office*